US005607088A

United States Patent [19]

Carranza

[11] Patent Number: 5,607,088

[45] Date of Patent: Mar. 4, 1997

[54] HANGER WIRE FORMS

[76] Inventor: Abraham Carranza, 2629 Tweedy Blvd., South Gate, Calif. 90280

[21] Appl. No.: 540,253

[22] Filed: Oct. 6, 1995

[51] Int. Cl.[6] ..... D06C 15/00; A47G 25/14

[52] U.S. Cl. ..... 223/66; 223/69; 223/85

[58] Field of Search ..... 223/66, 69, 70, 223/71, 120, 85

[56] References Cited

U.S. PATENT DOCUMENTS

| | | | |
|---|---|---|---|
| 2,536,187 | 1/1951 | Kosky et al. | 211/118 |
| 2,666,559 | 1/1954 | Wexler et al. | 223/68 |
| 2,669,375 | 2/1954 | Schilling | 223/68 |
| 2,998,903 | 9/1961 | Day | 223/68 |
| 4,917,278 | 4/1990 | Ventimiglia | 223/68 |
| 5,330,143 | 7/1994 | Rich et al. | 223/120 |

FOREIGN PATENT DOCUMENTS

| | | | |
|---|---|---|---|
| 896110 | 5/1962 | United Kingdom | 223/66 |

*Primary Examiner*—Bibhu Mohanty
*Attorney, Agent, or Firm*—Chenpatents

[57] ABSTRACT

A wire form for displaying, storing, and transporting clothing has a torso and hips. A bust line attached to the form under the arms with double curved portions extending laterally from the plane of the torso simulates a human, especially a female bust line to enhance the appearance of a garment.

9 Claims, 3 Drawing Sheets

HANGER WIRE FORMS

BACKGROUND OF THE INVENTION

1. Field of the Invention

The present invention relates to a novel wire form for displaying clothing. More specifically, the wire forms of this invention display the human torso, especially the female torso, in three dimensions.

2. Description of the Prior Art

Various hangers or solid forms, such as mannequins are known in the garment industry for the display, transport, or storage of garments. Solid forms including mannequins are costly to make, difficult to transport, and impossible to store compactly. U.S. Pat. Nos. 5,244,131 and 4,739,911 are examples of such forms.

Most wire hangers or stands show an outline of the garment in a plane without any depth dimension. U.S. Pat. Nos. 766,250, 1,929,284, 4,542,838 and 5,022,569 are hangers for displaying of clothing in a plane. U.S. Pat. Nos. 2,998,903, 4,109,838, and 4,917,278 use detachable loops or arches for displaying a full skirt, they do not display the female bust contour. As a result, female garments displayed on such hangers cannot fully display the garment's design and details.

Therefore, there is a need for an economically-produced wire form showing the human torso, especially the female torso, and fully displaying the design and details of a woman's garment. It is the object of this invention to provide such a wire form. A further object of this invention is to store a garment without being wrinkled or flattened during storage and transport. Yet another object is to provide a wire form that is light in weight and that can be stacked compactly. Many other features of the present invention will become apparent from reading the following detailed description in conjunction with the drawings.

SUMMARY OF THE INVENTION

The wire form of the present invention comprises an outline of the human torso, especially the female torso outline with a curved female bust line extending from the plane of the torso showing the depth of the body, a waist line and hips. A garment displayed on such a wire form creates the appearance of being worn on the human body. Such a wire form may be made with a hook affixed to the neck line, to facilitate hanging on a rod, or a post with a tripod or base plate supporting the form at the waste line and standing on the floor, or hooks for suspension from a clothes hanger.

DETAILED DESCRIPTION OF THE INVENTION

Figure 1A:
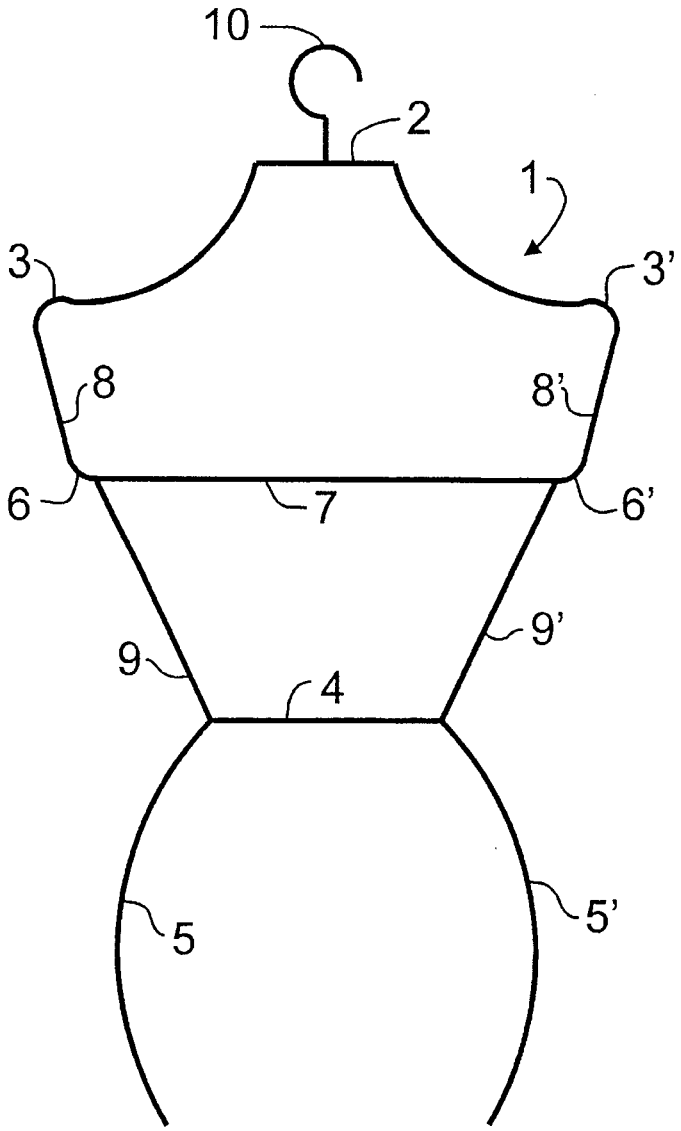
FIG. 1 *a* is front view of a wire hanger, and FIG. 1 *b* is a perspective view of the same hanger.

Referring to the drawings, wherein the same numerals refer to the same parts, a wire hanger generally referred to as 1, is formed by bending a first wire into symmetrical outline of the neck, shoulders, upper arms, armpits, chest, and hips. Accordingly, the first wire comprises a horizontal neck line 2, extending downwardly and outwardly in an arcuate manner to form shoulders 3 and 3'. Downwardly depending from the shoulders 3 and 3' are arms 8 and 8'. Connected to the arms 8 and 8', downwardly and inwardly, are two sides indicating the chest, 9 and 9', and the hips 5 and 5' extending downwardly and outwardly in an arcuate manner. A second transverse wire 4 forms a waist line connecting the two sides of the first wire at the points corresponding to the waist and mechanically strengthening the wire structure.

It is to be noted that outline formed by the first wire, comprising the neck 2, shoulders 3 and 3', and arms 8 and 8', are in one plane. At the two arm pits 6 and 6', there is provided a third wire creating a bust line, 7, extending outwardly and forwardly from the plane of the first wire on both sides and inwardly at the midpoint of line 7, thereby generating the outline of a female bust line. A hook 10 is fastened onto the neck line 2.

Figure 1B:
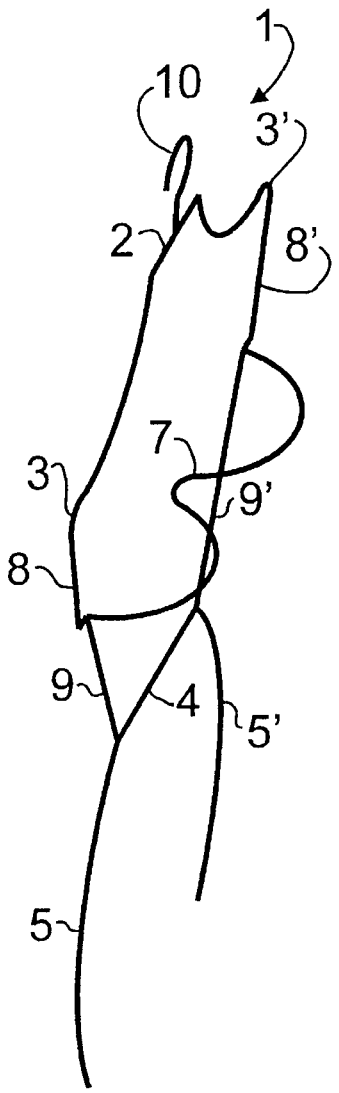
Figure 2:
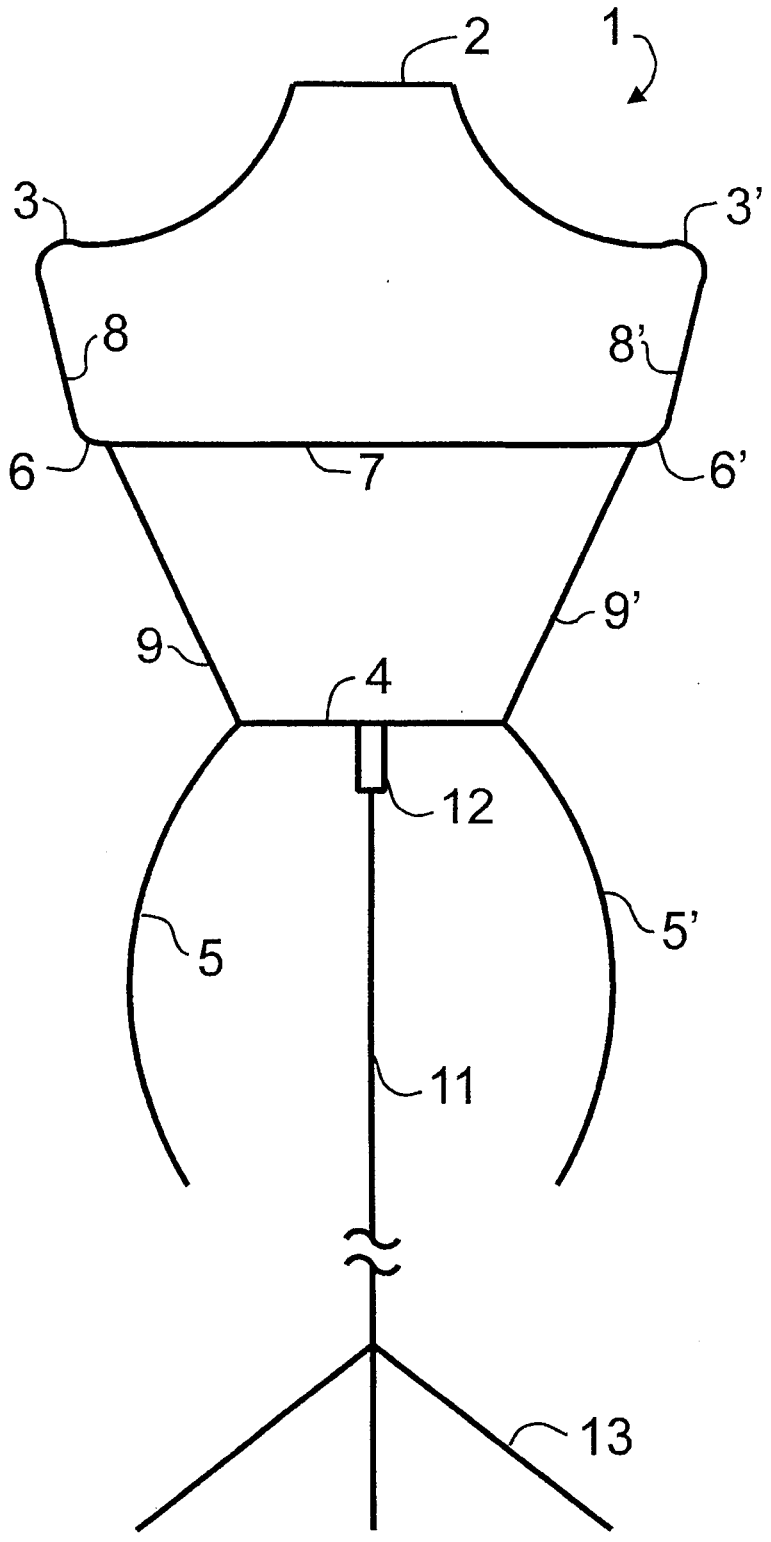
FIG. 2 shows a stand with the form of FIG. 1 without the hook. The form is supported by a tripod.

FIG. 2 shows the same wire form as FIG. 1 without the hook. The form is removably supported on a post 11, preferably a round solid steel rod ⅜' in diameter, which slips into a cup 12 fixed to the waist line 4 at its midpoint, for instance, by spot-welding. The cup 12 may be formed, for instance, by a length of pipe 2–3" in length, an outside diameter of about ½" and an inside diameter slightly greater than ⅜", such that the post 11 slips into the cup readily. The post has a tripod stand 13 and at its distal end. The tips of the tripod may optionally be provided with plastic or rubber caps to provide friction and to avoid scratching a polished floor. The tripod may optionally be foldable. Alternatively, the post may be affixed to a solid metal base plate, which provides stable support for heavy garments, or multiple garments, hung on the wire form. These alternative options are not illustrated.

Figure 3:
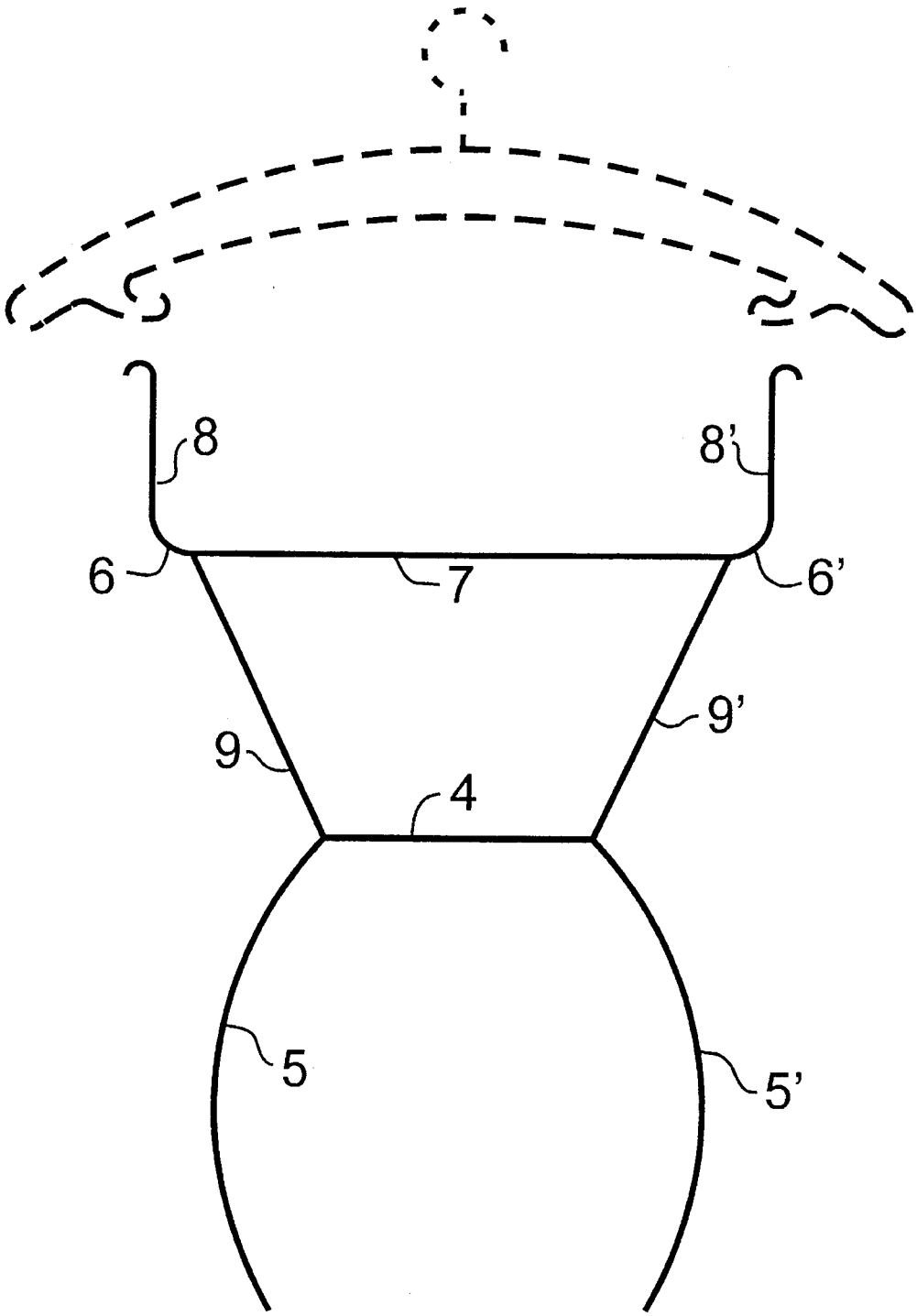
FIG. 3 shows wire form with shoulder lines terminating in hooks to be attached to a clothes hanger.

FIG. 3. is a wire form similar to that of FIG. 1, except the shoulders 3 and 3' and the neck portion 2 are omitted. The extending wires of the arms 8 and 8' are provided with hooks at the ends thereof to be hung on a clothes hanger having notches at both ends. The wire form of FIG. 3 has a bust line 7 as illustrated in FIG. 1 *b*. Optionally, a stiffening wire may be connected between the ends of the wires corresponding to the hips, 5 and 5'. This option is not illustrated.

The wire used in making the outline of the torso and hips, and the waist line, preferably is 9-gauge steel wire (U.S. wire gauge, 0.1483" diameter). All joints between sections of wire are spot welded and the joints are ground smooth. It is to be noted that the bust line created by the third wire 7 is not limited to the female figure only. For a male figure, the bust line is appropriately modified to reflect a male physique.

It is also to be noted that the process of making the hanger forms of this invention is extraordinarily simple and economical. The first wire, which forms the outline of the torso and the hips, including neck, shoulders, upper arms, armpits, the sides of the chest, and the hips, as illustrated by FIGS. 1 *a*, 1 *b*, and 2, is shaped first. It is then joined at the waist by the second wire by two welded joints. The third wire, joined to the first wire at the armpits by two welded joints and forming the bust line, completes the structure of the form. In the embodiment of the invention illustrated by FIG. 3, the first wire is replaced by two symmetrical wires forming the sides of the form.

Numerous alteration of the structure herein disclosed will suggest themselves to those skilled in the art. Therefore, it is to be understood that the present invention relates to the embodiment of the invention which is for purposes of illustration only and is not to be construed as a limitation of the invention.

What is claimed is:

1. A stackable wire form for garments having a torso and hips comprising a first wire formed into a symmetrical outline of a neck, shoulders, arms pits, chest, waist and hips; a second wire connecting the first wire at the waist; a third wire welded to the first wire at the armpits, the third wire extending outwardly from a plane of the first wire and inwardly at the center of the third wire to simulate a human's bust, whereby a garment displayed on the wire form appears as if it were worn on a human body; and means for supporting the wire form.

2. The wire form of claim 1 wherein the supporting means is a hook affixed on the first wire at the neck, whereby the wire form may be hung on a rod.

3. The wire form of claim 1 wherein the supporting means is a post connected at the midpoint of the second wire.

4. The wire form of claim 3 wherein the post fits removably into a cup affixed to the second wire at its midpoint.

5. The wire form of claim 3 wherein the post is supported by a tripod.

6. The wire form of claim 3 wherein the post is supported by a base plate.

7. The wire form of claim 5 wherein the tripod is foldable.

8. The wire form of claim 5 wherein the ends of the tripod have rubber caps.

9. A wire form for garments having a torso and hips comprising two opposed spaced first wires forming two arms spaced by a gap, two sides depending downwardly and inwardly, and two outwardly arcuate hips; a second transverse wire connecting the two sides at the hips forming a waist, all said first and second wires lying in one plane; and a third wire connected to the lower ends of the arms extending outwardly from the plane and inwardly at the center of the third wire to simulate a human's bust; the two arms having hooks at their distal ends enabling the form to be hung on a clothes hanger.

* * * * *